US005622218A

United States Patent [19]

Pedroza-Contreras

[11] Patent Number: 5,622,218

[45] Date of Patent: Apr. 22, 1997

[54] METHOD AND APPARATUS FOR CONTINUOUS CASTING OF STEEL MATERIALS

[75] Inventor: Miguel A. Pedroza-Contreras, Monterrey, Mexico

[73] Assignee: Hylsa S.A. de C.V., San Nicolas de los Garza, Mexico

[21] Appl. No.: 441,684

[22] Filed: May 15, 1995

[51] Int. Cl.[6] ..... B22D 11/07

[52] U.S. Cl. ..... 164/472; 164/268; 164/418; 164/459; 164/416; 164/478

[58] Field of Search ..... 164/472, 268, 164/418, 459, 416, 478

[56] References Cited

U.S. PATENT DOCUMENTS 5,311,921 5/1994 Smets ..... 164/268

FOREIGN PATENT DOCUMENTS 3-106545 5/1991 Japan ..... 164/472
6-79419 3/1994 Japan ..... 164/472

OTHER PUBLICATIONS

Rama Bommaraju, "Optimum Selection and Application of Mold Fluxes for Carbon Steels", 1991 Steelmaking Conference Proceedings, pp. 131 to 146 [Presented at the 74th Steelmaking Conference of the Iron and Steel Society, in Washington, D.C., on Apr. 14–17, 1991].

Jean–Pierre Birat, Michel Larrecq, Jean–Yves Lamant, Jacques Pétégnief,"The Continuous Casting Mold: A Basic Tool for Surface Quality and Strand Productivity", 1991 Steelmaking Conference Proceedings, pp. 39 to 50 [Presented at the 74th Steelmaking Conference of the Iron and Steel Society, in Washington, D.C., on Apr. 14–17, 1991].

M. Nogues, Mme. Roscini, M. Forgeoux, "Lubrication of Continuously Casted Billet Mold by Ultrasonic Vibration", METEC Congress 94: 2nd European Continuous Casting Conference; 6th International Rolling Conference, Düsseldorf, Jun. 20–22, 1994; Proceedings Vol. 1, published by the German Iron and Steel Institute, pp. 119 to 125.

Kenneth C. Mills, "The Performance of Casting Powders and Their Effect on Surface Quality", 1991 Steelmaking Conference Proceedings, pp. 121 to 129 [Presented at the 74th Steelmaking Conference of the Iron and Steel Society, in Washington, D.C., on Apr. 14–17, 1991].

Shuji Takeuchi, Yuji Miki, Seiji Itoyama, Kazuko Kobayashi, Ken–ichi Sorimachi, and Toshigazu Sakuraya, "Control of Oscillation Mark Formation during Continuous Casting", 1991 Steelmaking Conference Proceedings, pp. 73 to 77 [Presented at the 74th Steelmaking Conference of the Iron and Steel Society in Washington, D.C., on Apr. 14–17, 1991].

J. K. Brimacombe and K. Sorimachi, "Crack Formation in the Continuous Casting of Steel", Metallurgical Transactions B, vol. 8B, Sep. 1977, pp. 489 to 505.

(List continued on next page.)

*Primary Examiner*—Joseph J. Hail, III
*Assistant Examiner*—I. Lin
*Attorney, Agent, or Firm*—A. Thomas S. Safford

[57] ABSTRACT

Method of continuously casting steel slabs and the like wherein a layer of melting powder is maintained at the top portion of the casting mold with sufficient thickness so as to provide an increased thermal insulation to the liquid layers of steel and slag, whereby the formation of a solidified slag rim in the mold is eliminated and the surface quality of the steel products is considerably improved. The melting powder addition according to the invention also reduces the number of break-outs and consequently considerably increases the availability and productivity of the caster.

11 Claims, 3 Drawing Sheets

OTHER PUBLICATIONS

I. Jimbo, B. Ozturk, S. Feldbauer and A.W. Cramb, "Some Aspects of Chemical Phenomena in the Mold of a Continuous Slab Caster", 1991 Steelmaking Conference Proceedings, pp. 153 to 154 [Presented at the 74th Steelmaking Conference of the Iron and Steel Society, in Washington, D.C., on Apr. 14–17, 1991].

Ismael G. Saucedo, "Early Solidification during the Continuous Casting of Steel", 1991 Steelmaking Conference Proceedings, pp. 79 to 89 [Presented at the 74th Steelmaking Conference of the Iron and Steel Society, in Washington, D.C., on Apr. 14–17, 1991].

Hiroaki Yama–zoye, Yoshinori Tanizawa, Atsushi Satoh, and Takeyuki Hirata, "Development of Submerged Nozzle for Reduction of Longitudinal Cracks on Continuously Cast Slabs", Kashima Steel Works, Sumitomo Metal Industries, Ltd., METEC Congress94; 2nd European Continuous Casting Conference; 6th International Rolling Conference, Düsseldorf, Jun. 30–22, 1994; Proceedings vol. 1, published by the German Iron and Steel Institute, pp. 264–270.

METHOD AND APPARATUS FOR CONTINUOUS CASTING OF STEEL MATERIALS

FIELD OF THE INVENTION

The present invention relates to the continuous casting of steel materials, more particularly, continuous casting of carbon steel thin slabs useful for fabrication of hot rolled steel sheet.

The invention provides a method for modifying the heat transfer pattern at the top of the casting mold by maintaining a layer of heat insulating powder of sufficient thickness so as to homogenize the heat transfer pattern at the top portion of the casting mold, whereby the quality of the steel sheet is greatly improved with a minimum number of longitudinal cracks.

BACKGROUND OF THE INVENTION

The surface quality of continuously cast steel slabs, which are subsequently rolled to steel sheet is one of the most important attributes that determine the sheet product quality in the modern steel industry. In the extremely competitive steel industry, the cast surfaces have to be essentially free of all defects, particularly in plants having near net shape and thin slab casting.

Surface defects are related to a number of factors, such as entrapped flux, solid and liquid inclusions, surface and subsurface cracking, and mold oscillation marks. Many studies have been made seeking the reasons and remedies to correct particularly such defects as longitudinal cracks and mold oscillation marks. Applicant has discovered that one of the factors causing these defects is the formation of a solidified rim of slag at the top portion of the casting mold, due to the heat loss to the mold and to the environment of the liquid slag formed by the melting mold powder.

Mold powders provide chemical and thermal insulation to the molten steel surface and control the heat flow and friction between the mold and the initial steel shell formed as the slab undergoes solidification. The rapid cooling exerted by the water-cooled mold on the liquid steel in order to promote solidification thereof, results in steep temperature gradients in the solid shell generating thermal strains as the shell expands and contracts. Also the semisolid steel is subjected to mechanically induced stresses by the friction of the steel with the mold (including vertical oscillations). Any of these stresses and strains at the initial solidification of the shell may result in crack formation on the slab surface.

Mold powder melts to form a layer of liquid slag between the solidifying steel and the mold, which controls friction and also insulates the liquid steel and molten powder slag at the top of the mold. Typical operating practice for addition of mold powder is described by Rama Bommaraju, "Optimum selection and application of Mold fluxes for carbon steels", presented at the 74th Steelmaking Conference of the Iron and Steel Society, in Washington, D.C., on Apr. 14–17, 1991 (incorporated herein by reference). In this article the author discourages the tendency of operators to add large quantities of mold powder and wait until it turns red-hot and then make the next addition. The author concludes that in most instances, the liquid layer of slag should be maintained above 6 to 12 mm. This can usually be achieved by maintaining a minimum of 25 mm thickness of unreacted solid powder layer. The author recognizes that the powder also thermally insulates the slag and prevents it from freezing in the mold which may cause freezing of the steel meniscus and other problems. The author suggests to cascade the powder over the edge of the mold and to maintain the area between the mold wall and the shroud of the Submerged Entry Nozzle (SEN) always covered with a 25 to 50 mm (1–2 inches) thick powdered layer, plus perhaps another 1–2 inches during start-up or tundish or tube changes.

It has been found that the current practices, including the aforementioned mold powder addition, is not satisfactory to increasingly demanding customers and that such practices are still causing many defects in the products, as for example longitudinal cracks and oscillation marks. The technical literature in this field is full of discussions and explanation of the phenomena involved in the early solidification stages of continuously cast slabs, as well as including many proposals and countermeasures to minimize such quality problems. For example increase the mold oscillation frequency, to increase the downward speed of the mold, to insert an area of chromium carbide at the top area of the mold in order to create a "hot spot" thus decreasing the extension of such solidified rim, etc.

Another proposal to improve the surface quality is to apply electromagnetic or magneto-hydrodynamic forces to generate stirring of the liquid steel and consequently to improve the uniformity of heat transfer and solidification.

None of the above techniques however has been completely successful in the elimination of longitudinal cracks and oscillation marks, and the technical literature accepts the problem of slag rim formation as an unavoidable consequence of the mold cooling. With the method of the present invention it has been found that the solidified slag rim is eliminated and the no longitudinal cracks have been detected in the product.

OBJECTS AND SUMMARY OF THE INVENTION

It is therefore an object of the present invention to provide a method and apparatus for continuous casting of steel to eliminate longitudinal cracks in the cast slab surface. Other objects of the invention will be in part obvious and in part pointed out hereinafter.

Applicant achieves this object by providing that the top portion of the casting mold is sufficiently thermally insulated to minimize the solidified slag rim formed in the prior art. More particularly this invention provides method and apparatus to improve the surface quality of continuously cast steel product by maintaining a layer of melting powder having a predetermined thickness at the top portion of the casting mold.

The present invention can be usefully incorporated in a continuous casting system for casting of steel slabs, and the like, where an oscillating casting mold is used and melting powder is added for thermal insulation and lubrication. According to the present invention the objects thereof are achieved by providing a method for continuous casting of steel slabs and the like, comprising pouring liquid steel into an oscillating casting mold through a submerged refractory nozzle; adding a solid mold powder to the top portion of said casting mold, whereby a portion of said mold powder is melted and forms a layer of liquid slag above said liquid steel in said mold; said mold powder being added to provide control of friction of said steel and said mold and also to provide thermal insulation between the liquid phases of steel and slag and the environment; characterized by maintaining a layer of solid mold powder at the top portion of said mold with a thickness in the range from 6 to 8 inches, whereby the thermal insulation at the top portion of said mold is increased and the quality of said continuously cast slabs is improved.

BRIEF DESCRIPTION OF THE DRAWINGS

In this specification and in the accompanying drawings, some preferred embodiments of the invention are shown and described and various alternatives and modifications thereof have been suggested; but it is to be understood that these changes and modifications can be made within the scope of the invention. The suggestions herein are selected and included for purposes of illustration in order that others skilled in the art will more fully understand the invention and the principles thereof and will thus be enabled to modify it in a variety of forms, each as may be best suited to the conditions of a particular use.

DETAILED DESCRIPTION OF THE INVENTION

Figure 1:
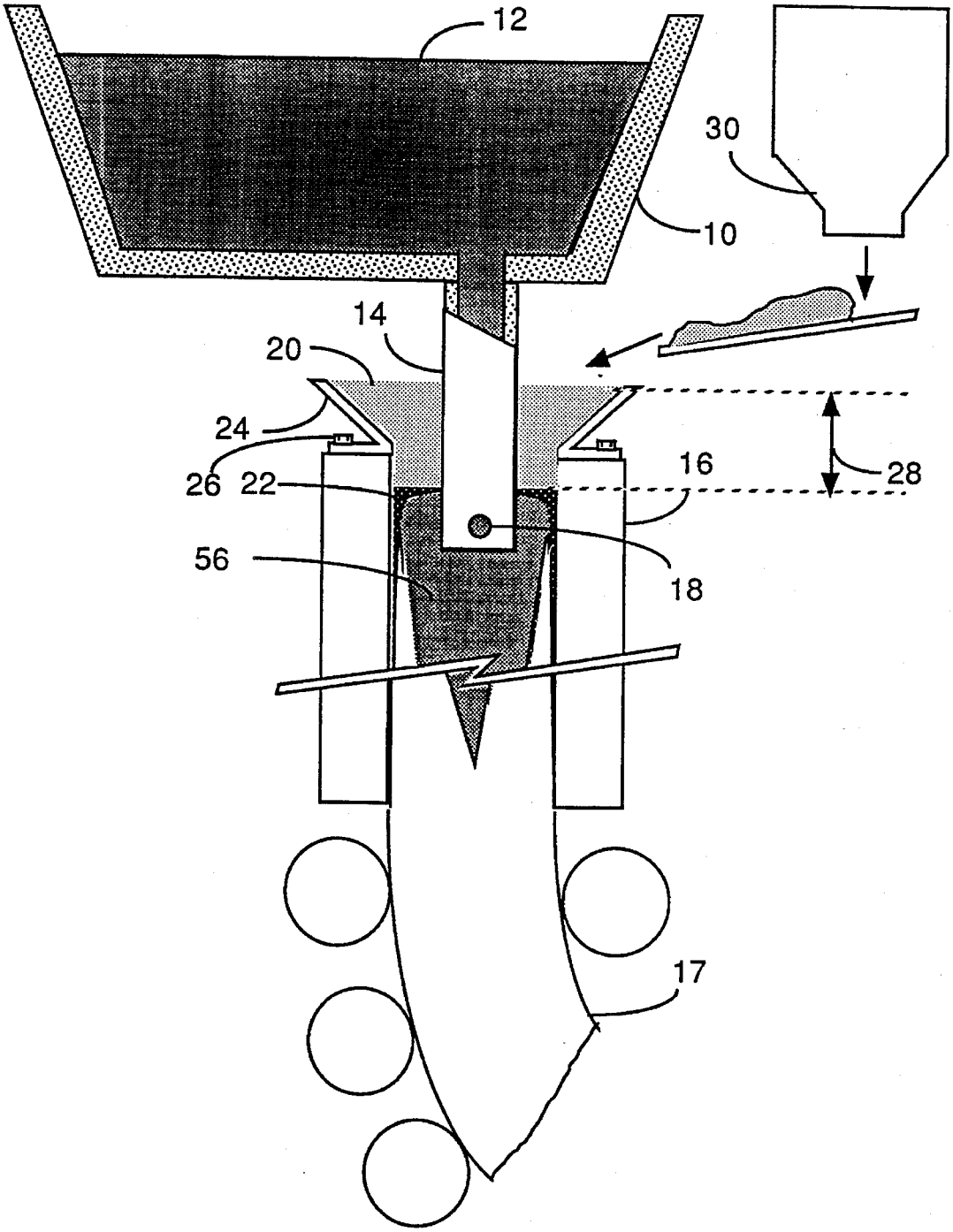
FIG. 1 is a schematic diagram of a continuous casting system showing the incorporation of the invention in a casting mold of the prior art.

Referring to FIG. 1, numeral 10 generally designates a tundish holding liquid steel 12 ready to be cast through a submerged entry nozzle (SEN) 14 in a manner known in the art. The liquid steel is poured into a standard oscillating continuous casting mold 16 through suitably distributed openings 18 and begins its solidification by the rapid heat transfer to the copper mold which is designed to take large amounts of heat from said liquid steel to a cooling fluid, normally water. The mold 16 oscillates in the vertical direction by means of hydraulic drives in order to disengage the solidified slab 17 from the mold while said slab is continuously flowing downwards to be further processed in a continuous rolling mill. Mold powder 20 is periodically added at the top of mold 16 in order to maintain a layer of solid powder thereon to provide insulation between the liquid steel 56 and the environment and also to provide lubrication between the solid steel 17 and the mold, among other purposes.

A portion of the mold powder 20 is melted by contact with the liquid steel forming a layer of liquid slag 22, which provides the lubrication between the solid steel 17 and the mold by flowing downwardly in the peripherical zone adjacent to the mold walls.

Following the current practice, the solid mold powder is contained by the mold walls since the depth of the powder layer is in the order of 25 mm or 1 inch, at most it reaches 2.5 inches when the operators exceed the currently recommended thickness. According to this invention, the mold itself may be of a sufficient height so as to contain said solid powder layer with a thickness in the range of 6 to 8 inches. Alternatively, a conventional mold may be modified by a container 24 fastened to the top of the mold by suitable means 26 in order to hold at least a depth 28 in the range of 6 to 8 inches of powder at the top of the liquid steel 56. It is understood that the shape and materials of the container 24 may vary according to the particular circumstances of each casting machine, and that the method of addition of said powder may be manual or automatic. One can periodically determine the thickness of said layer of solid mold powder sufficiently often, and add more mold powder as needed, such that the thickness of said layer is maintained in the desired range of 6 to 8 inches at the top of said mold. For example it can be cascaded from a nearby bin 30 or through suitable piping. Also the addition of mold powder can be made automatic by determining the thickness of powder layer and acting on a dosification system in response to said determination. Another embodiment of this alternative is to set a predetermined level in the container and adding the amount of powder necessary to reach said predetermined level.

Any type of container of suitable shape and material can be adapted to the top of the casting mold. The powder addition can be made automatically by a suitable dosification system controlled by and/or responding to a suitable measuring means for determination of the thickness of said powder layer.

The purpose of the thick layer of solid powder at the top of the casting mold is to provide an increased thermal insulation between the liquid materials in the mold and the environment. If the layer is of a small thickness as in the current practice, the temperature of the top portion of the mold is not homogeneous and also causes a solidified slag rim formation resulting in quality problems known, but not understood, by those skilled in this art.

Figure 2:
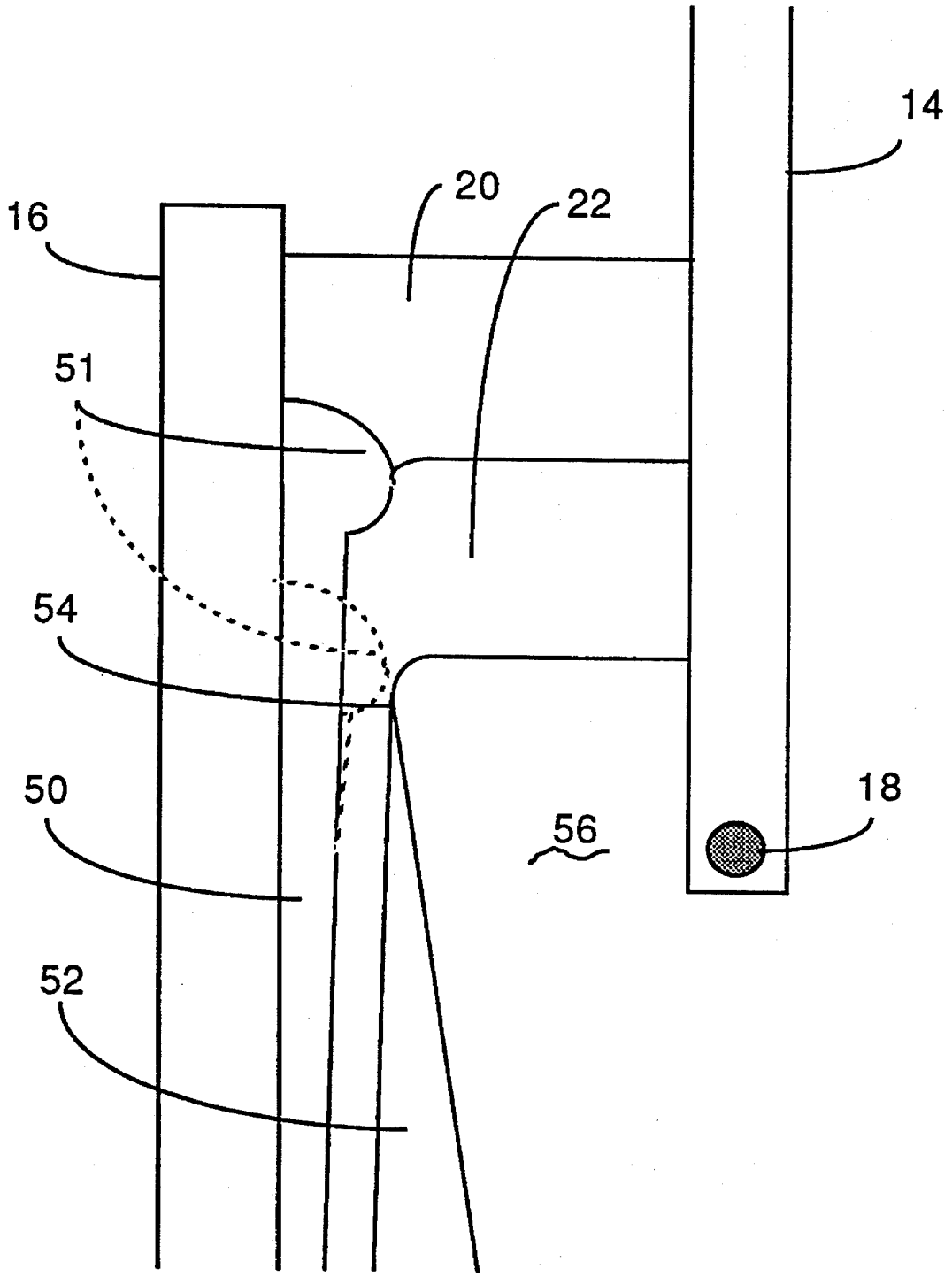
FIG. 2 is a schematic diagram illustrating a casting mold of the prior art and the formation of a solidified slag rim, (showing in dotted outline the vertical displacement, exaggerated for purposes of clarity, of the solid slag rim relative to the solidifying steel shell).

Referring to FIG. 2, where the prior art practice is illustrated, only the top portion of one side of mold 16 is shown, a layer of solidified mold powder is adhered to the inner face of said mold. A slag rim 51 is formed around the mold in this layer of solid slag 50, probably because the steel and slag lose heat to the environment through the layer of solid powder 20. As the mold 16 oscillates in the vertical direction, this rim 51 may touch the meniscus 54 which is the top part of the solidified shell of steel 52, causing defects in the product slab as cracks and oscillation marks. The shell 52 surrounds the liquid core 56 which becomes solid as it advances through the mold.

Figure 3:
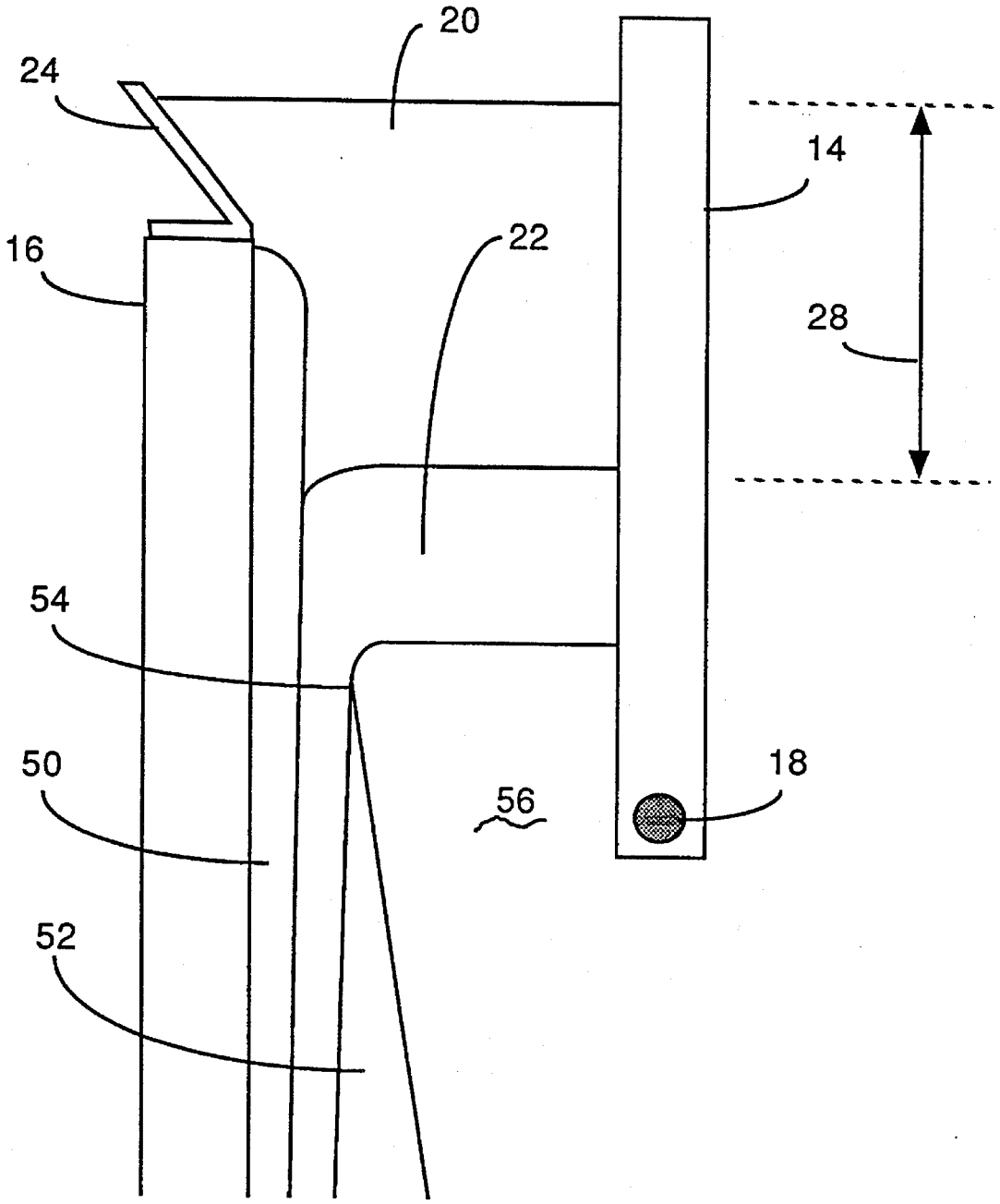
FIG. 3 is a schematic diagram illustrating a casting mold (without formation of the slag rim) and the with layer of mold powder, added according to the invention, being shown in dotted outline.

FIG. 3 illustrates the same diagram of FIG. 2 but with a thick layer of mold powder and the absence of said slag rim. The applicant found that with the thick solid powder layer according to the invention, no rim was detected in the mold and that the number of break-outs (meaning the number of times when the steel cast operation in the mold is interrupted) per each thousand of meters cast has been about 0.18 and 0.0 during the first two months of operation while in another similar steel making plant this parameter reached values of one order of magnitude higher.

It is of course to be understood that the foregoing description is intended to be illustrative only and that numerous changes can be made in the structure of the system described and its operating conditions without departing from the spirit of the invention as defined in the appended claims.

What is claimed is:

1. A method for continuous casting of a steel slab, comprising providing an oscillating casting mold with an upwardly extending top portion above the area of said mold where said steel is cast; pouring liquid steel into said mold through a submerged refractory nozzle; adding as needed a solid mold powder to the top portion of said casting mold with the portion of said mold powder in contact with said liquid steel melting and forming a layer of liquid slag above said liquid steel in said mold; said melted mold powder also serving to lubricate and reduce friction of said solidifying steel along its interface with said mold; said still-solid mold powder serving to cover and provide thermal insulation between the liquid phases of steel plus slag and the surrounding environment of the mold; maintaining on top of said liquid steel and slag a layer of solid mold powder with a thickness in the range of at least 6 to 8 inches by mean of the upwardly extending top portion, sufficient to effectively thermally insulate the top portion of said mold to increase the surface quality of said continuously cast slab.

2. A method for continuous casting of a steel slab according to claim 1, further comprising said mold being inclusive of the upwardly extending top portion and thus being of sufficient height so as to contain said solid powder layer with a thickness in the range of 6 to 8 inches.

3. A method for continuous casting of a steel slab according to claim 1, wherein said layer of solid mold powder is maintained with a thickness sufficient to diminish or eliminate the presence of an inwardly protruding solidified slag rim.

4. A method for continuous casting of a steel slab according to claim 1, further comprising periodically determining the thickness of said layer of solid mold powder sufficiently often, and adding more mold powder as needed, such that the thickness of said layer is maintained in the range of 6 to 8 inches at the top of said mold.

5. A method for continuous casting of a steel slab according to claim 2, further comprising providing a container at the top of said mold to function as the upwardly extending top portion of said mold and surrounding the area of said mold where said steel is cast; and adding an amount of solid mold powder in said container up to a predetermined level in said container.

6. A method for continuous casting of a steel slab according to claim 5, wherein said addition of mold powder is made automatically in response to said determination of the thickness of said layer of solid mold powder.

7. A method for continuous casting of a steel slab according to claim 1, wherein said steel is cast as a thin steel slab.

8. A method for continuous casting of a steel slab according to claim 7, wherein said thin steel slab has a near net shape to the final rolled sheet steel end product.

9. Apparatus for continuous casting of a steel slab, comprising an oscillating cooling mold having a top opening and a bottom opening, a nozzle for pouring liquid steel into said mold at a point proximal to said top opening, and an upwardly extending auxiliary container wall attached to the top portion of said mold around said top opening sized sufficient to maintain a deeper layer of solid mold powder at a predetermined height at the top portion of said mold in order to increase the thermal insulation of the top portion of said mold and of the liquid steel and liquid slag covering steel solidifying in said mold with respect to the surrounding environment of said mold.

10. Apparatus for continuous casting of a steel slab according to claim 9, wherein the height of said container wall is adapted to maintain the height of said layer of solid powder in the range of 6 to 8 inches.

11. Apparatus for continuous casting of a steel slab, comprising an oscillating cooling mold having a top opening and a bottom-opening, a nozzle for pouring liquid steel into said mold at a point proximal to said top opening to form a steel slab with a molten upper surface within the top opening, a container wall at the top portion extending upwardly sufficiently to maintain a layer of solid mold powder at a height in the range of 6 to 8 inches above said upper surface, a sensing device for determining the thickness of a layer of solid mold powder present in the container wall, a feed device responsive to said determination for maintaining said layer of powder within the 6 to 8 inch height range.

* * * * *